United States Patent [19]

Zald et al.

[11] Patent Number: 4,676,447

[45] Date of Patent: Jun. 30, 1987

[54] WEB UNWIND-SPLICER APPARATUS

[75] Inventors: Roberta L. Zald; Stanley L. Adams; David P. Welch, all of Cincinnati, Ohio

[73] Assignee: The Procter & Gamble Company, Cincinnati, Ohio

[21] Appl. No.: 603,525

[22] Filed: Apr. 24, 1984

[51] Int. Cl.[4] ..... B65H 19/16; B65H 19/18; B65H 23/185

[52] U.S. Cl. ..... 242/58.4; 242/75.1

[58] Field of Search ..... 242/58.1–58.5, 242/206–210, 75.1; 156/502, 504, 505; 226/195

[56] References Cited

U.S. PATENT DOCUMENTS

| | | | |
|---|---|---|---|
| 2,222,462 | 11/1940 | Kaddeland | 242/75.1 |
| 2,899,143 | 8/1959 | Crosfield et al. | 242/58.3 |
| 3,089,661 | 5/1963 | Phillips, Jr. et al. | 242/58.3 X |
| 3,326,156 | 6/1967 | Cobble, Sr. et al. | 226/195 X |
| 3,414,208 | 12/1968 | Butler, Jr. et al. | 242/58.1 |
| 3,645,463 | 2/1972 | Helm | 242/58.1 |
| 3,836,089 | 9/1974 | Riemersma | 242/58.1 |
| 3,873,393 | 3/1975 | Bruck et al. | 242/58.1 X |
| 3,918,655 | 11/1975 | Hillner et al. | 242/58.1 |
| 3,939,031 | 2/1976 | Takimoto | 156/505 |
| 4,100,012 | 7/1978 | Melhofer et al. | 156/504 X |
| 4,151,594 | 4/1979 | Stern | 242/58.1 X |
| 4,342,314 | 8/1982 | Radel et al. | 128/287 |

*Primary Examiner*—Harvey G. Hornsby
*Assistant Examiner*—Scott J. Haugland
*Attorney, Agent, or Firm*—Thomas J. Slone; Fredrick H. Braun; Richard C. Witte

[57] ABSTRACT

An apparatus is provided wherein web material is unwound from successive rolls of web material by imparting a constant draw in the web material. The web is then forwarded through a constant tension zone to downstream equipment such as a converter for manufacturing disposable absorbent products. The constant tension zone is provided to isolate the web being forwarded under constant tension from tension fluctuations which may occur in the constant draw unwind portion of the apparatus: such tension fluctuations being relatively large in magnitude and random in nature especially with net-like webs, and blocking prone web marterials. A splicer is provided in the constant tension zone in close proximity to the constant-draw unwind to effect splices near the tail end of a just depleted roll of web but prior to the tail end passing out of the constant-draw unwind portion of the apparatus. Additionally, the apparatus is slaved to the downstream equipment so that it responds in timed relation with changes made in the speed of the downstream equipment.

4 Claims, 4 Drawing Figures

WEB UNWIND-SPLICER APPARATUS

DESCRIPTION

1. Technical Field

This invention pertains to a method of and apparatus for unwinding a succession of rolls of web material, and for splicing the leading edge of web from each successive roll of web to a tail-end portion of each roll as it becomes depleted so that a continuous ribbon of the web material is forwarded from the apparatus. Such rolls of web material may, for example, be thermoplastic films, or thermoplastic net-like materials such as used in absorbent products such as sanitary napkins, panty liners, and disposable diapers and the like. Indeed, the present invention has been found to be especially useful for unwinding such webs which have some blocking propensity, and which must be forwarded under very low tension to obviate their being distorted during subsequent combining operations in converting apparatuses for manufacturing such absorbent products although it is not intended to thereby limit the scope of the present invention.

2. Background Art

A thermoplastic web having a net-like construction and which may have some blocking propensity is disclosed in U.S. Pat. No. 4,342,314 which issued Aug. 3, 1982 to Clifford J. Radel and Hugh A. Thompson. Such webs are exemplary of webs which may be unwound, spliced and forwarded in accordance with the present invention.

U.S. Pat. No. 3,414,208 which issued Dec. 3, 1968 to R. A. Butler, Jr. et al discloses an Apparatus For Controlling The Unwinding Of Web, and U.S. Pat. No. 3,836,089 which issued Sept. 17, 1974 to Coenraad E. Riemersma discloses a Web Splicing, Unwinding And Forwarding Apparatus. Both of these apparatuses include means for controlling web tension to some extent but do not provide means for unwinding the web by imparting constant draw to it as is provided by the present invention. Additionally, U.S. Pat. No. 3,645,463 which issued Feb. 29, 1972 to Frank R. Helm discloses a Web-Splicing apparatus which is representative of web splicing apparatuses which may include means for cutting the webs being spliced as opposed to splicing free tail ends to the leading edges of new rolls of web material.

3. Disclosure Of The Invention

In accordance with one aspect of the invention, an apparatus for unwinding a succession of rolls of web material and continuously supplying on demand a running ribbon of the web material to downstream equipment is provided which includes means for rotatably mounting the rolls to be unwound, fixed-draw means for effecting unwinding by subjecting the web material to a predetermined fixed draw, drive and control means for effecting the fixed-draw unwind so that it is responsive to a line speed demand signal from the downstream equipment, and so that a predetermined constant level of tension is maintained in the web downstream of the fixed-draw means. The apparatus may also include splicing means disposed in the constant tension run of the web; and the splicing means is preferably disposed immediately downstream of the fixed-draw means. Additionally, the apparatus includes splicing control means for effecting splices prior to the free end of a just depleted roll of web exiting from the fixed-draw means so that the free end is still under control of the fixed draw means at the time the splice is effected just downstream of the fixed-draw means. Also, the fixed-draw means are preferably so configured and disposed that the length of the span of web being subjected to the fixed-draw is relatively short. In another aspect of the invention, a concomitant method is provided for continuously unwinding and forwarding a ribbon of web material by first subjecting a short span of the material to a fixed-draw, and then forwarding the web under constant tension downstream from the fixed-draw span of the web. This method obviates tension variations which may occur in the fixed-draw unwinding of the web from precipitating deliterious ramifications in, for example, downstream converting apparatus.

BRIEF DESCRIPTIONS OF THE DRAWINGS

While the specification concludes with claims which particularly point out and distinctly claim the subject matter regarded as forming the present invention, it is believed the invention will be better understood from the following descriptions taken in conjunction with the accompanying drawings in which identical features in the several views are identically designated and in which:

DETAILED DESCRIPTION OF THE INVENTION

Figure 1:
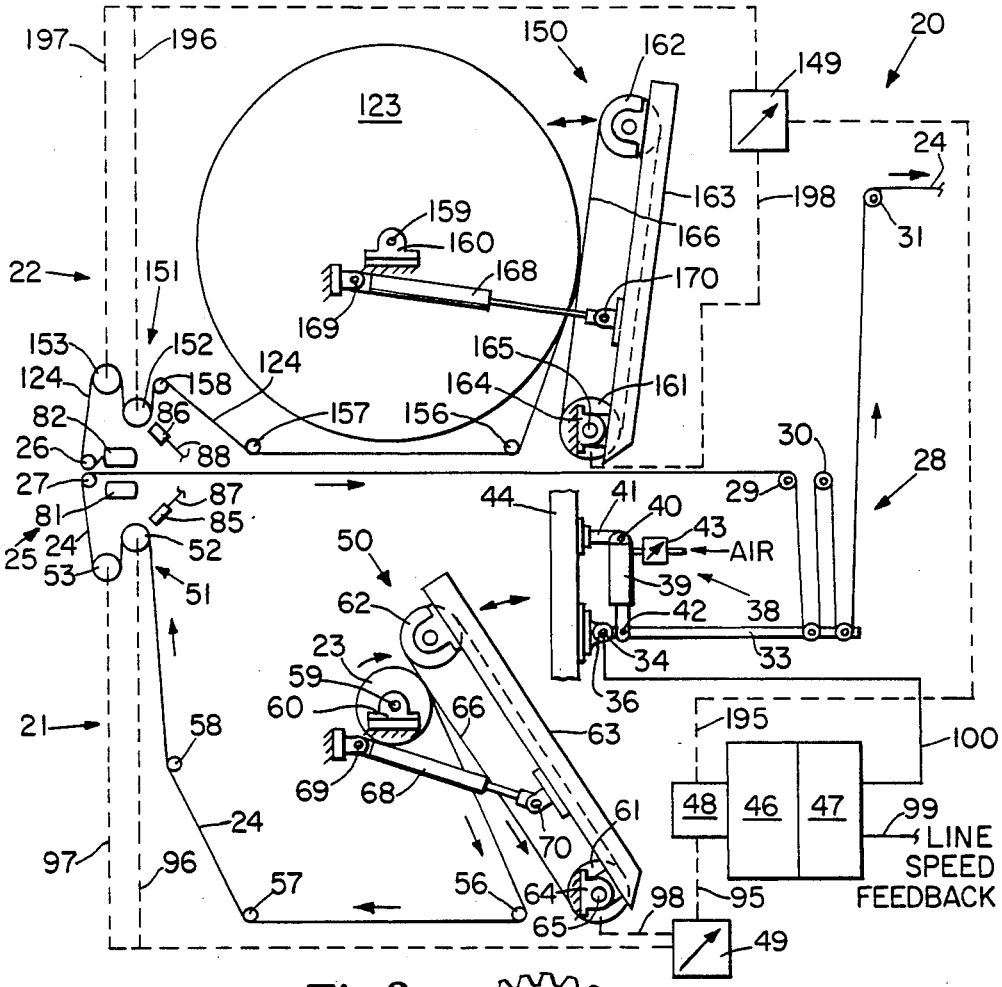
FIG. 1 is somewhat schematic side elevational view of an exemplary apparatus embodiment of the present invention.

An exemplary unwind-splicer apparatus 20 which is an exemplary embodiment of the present invention is shown in FIG. 1 to comprise lower unwind stand 21, an upper unwind stand 22, splicing means 25, idler rolls 26 and 27, a dancer assembly 28, drive means 46, drive control means 47, and selective clutch means 48. As shown in FIG. 1, a roll 23 of web 24 is shown nearing exhaustion in the lower unwind stand 21, and another roll 123 of web is shown in the upper unwind stand with its leading edge portion affixed in the splicing means in readiness for a splicing event.

Parenthetically, apparatus 20 is particularly well suited for unwinding flimsy, net-like webs of, for example, thermoplastic materials: e.g., webs such as those disclosed in U.S. Pat. No. 4,342,314 referenced hereinbefore. Such webs may become permanently distorted by as little as about five (5) percent elongation, and must therefore be handled at low tensions. Additionally, when such materials are wound into rolls upon manufacture so that they can subsequently be unwound in a web converting apparatus, the web is preferably subjected to an initial level of tension when the roll is commenced, and the tension is lessened as the diameter of the roll increases. Indeed, the initial tension may be controlled at as great as six (6) times or more than the level at the end of winding a roll of such web. This provides the roll with sufficient structural integrity to be shipped, placed in a converter, and unwound without incident. Unless wound with sufficient tension, the plies of the roll may slip and cause the roll to become cone-shaped. Concomitantly, if wound with tension too high, permanent web deformation may occur. In any event, the variation in tension when rolls of such web are wound must be dealt with when the roll is unwound. That is, the unwinding apparatus must be able to respond to the tension variations in the wound web as well as any degree of blocking which may have occurred to the web while in such rolls. Apparatus 20 is adapted to deal with these wound-tension and blocking variabilities by comprising means for effecting unwinding by imparting a fixed-draw to the web; and then forwarding the web to downstream equipment under substantially constant tension as is described in greater detail hereinbelow.

Basically, the apparatus 20, FIG. 1, functions to alternately unwind rolls of web material which are rotatably mounted in the unwind stands 21 and 22; to effect the unwinding by imparting a predetermined fixed-draw to the web by rotating the respective S-wrap rolls 51 and 151 of the unwind stands at predetermined surface velocities which are greater by a predetermined percentage than the surface velocities at which the rolls of web are driven by their respective peripheral belt drives 50 and 150; to control the speed of the fixed-draw unwinding responsive to a demand speed of downstream equipment so that the web being forwarded downstream from the S-wrap rolls is so forwarded under constant tension; and to splice the leading edge of the next successive new roll of web to a tail-end portion of the just depleted roll of web in the constant tension run of the web. Preferably the splicing means are disposed just downstream from the S-wrap rolls, and the splicing events are effected prior to the very tail-end edges of the just depleted rolls of web exiting from the fixed-draw portions of the unwind stands. Also, preferably, the S-wrap rolls are disposed adjacent their respective rolls of web that the fixed-draw spans thereof are relatively short: sufficiently short that the free end portions can be controlled during the time the end leaves its respective spool and until the next splice is effected. Parenthetically, the leading edge of each new roll is obviously spliced to a tail-end portion of the just depleted roll somewhat ahead of the actual trailing edge of the just depleted roll of web due to preferentially placing the splicing means in the constant tension run of the web, and preferentially effecting the splices prior to the very tail end edge portion of the just depleated roll of web exiting from the fixed-draw portion of its associated unwind stand: preferably the resulting free length of web from the just depleated roll of web will be on the order of a foot or less so that there is little downstream disruption precipitated thereby.

The lower unwind stand 21, FIG. 1, comprises a differential 49 which may be adjustable, peripheral drive means 50, S-wrap drive rolls 52 and 53, idler rolls 56 through 58, and shaft 59 on which roll 23 is mounted and which shaft is rotatably mounted in bearing block 60. Adjusting the differential is, of course, the manner in which the degree of fixed-draw is adjusted: i.e., by adjusting the differential velocity of the S-wrap rolls vs. the velocity of the peripheral drive means.

The peripheral drive means 50, FIG. 1, of the lower unwind stand comprises drive roll 61, idler roll 61, chassis 63, bearing block 64, pivot pin 65, drive belt 66, loading actuator 68, and pivot pins 69 and 70. Briefly, when the clutch assembly 48 is activated to power the lower unwind stand via the mechanical interconnect indicated by dashed line 95, output 98 from differential 49 powers the driven roll 61 which, in turn, powers drive belt 66; and outputs 96 and 97 from differential 49 power the S-wrap rolls 52 and 53 so that the ratio of the peripheral velocity of the S-wrap rolls to the surface velocity of the driven belt is sufficiently greater than one to achieve the desired degree of fixed-draw in the span of web coursing from the roll 23 of web 24 to the S-wrap rolls. Of course, the actuator is supplied with sufficient pressure that driving the driven belt will rotate roll 23 in timed relation with its associated S-wrap rolls to effect the desired fixed-draw in the web being unwound from roll 23.

Still referring to FIG. 1, the upper unwind stand 22 is substantially identical to the lower unwind stand 21. Accordingly, the elements of unwind stand 22 which correspond to elements of unwind stand 21 are identically designated but for having one-hundred (100) added thereto. For example, peripheral drive 150 of unwind stand 22 is the counterpart of peripheral drive 50 of unwind stand 21; and S-wrap drive 151 which comprises rolls 152 and 153 of unwind stand 22 corresponds to S-wrap drive 51 which comrises rolls 52 and 53 of unwind stand 21, respectively. Therefore, inasmuch as unwind stands 21 and 22 are substantially identically configured and operated, further description of the upper unwind stand is omitted in order to avoid undue redundancy in their descriptions.

As shown in FIG. 1, rolls 23 and 123 are both disposed in apparatus 20 to be unwound by rotating them clockwise. Alternatively, they may be reversed: i.e., disposed to be unwound by counterclockwise rotation. In this event, the web from roll 23 would be looped downwardly about idler roll 57, and then upwardly along the remainder of the path shown in FIG. 1. While the web could also be looped about idler roll 56, such is not preferred. In the same manner, the web from a reversed roll 123 would preferably be looped downwardly about idler roll 157, and then along the remainder of the path shown in FIG. 1. Of course, in the event reverse rotation of rolls 23 and 123 is desired, peripheral drives 50 and 150 must also be reversed by means not shown in FIG. 1.

Referring again to FIG. 1, the dancer assembly 28 comprises: fixed position idler rolls 29, 30, and 31; dancer frame 33 having its proximal end rotatably affixed in a bearing block by pivot pin 34 and having two idler rolls rotatably mounted near its distal end; a dancer position transducer 36; variable dancer loading means 38 comprising actuator 39, pivot pin 40, clevis block 41, pivot pin 42, and a pressure controller 43. The dancer assembly is affixed to the frame 44 of apparatus 20, a fragmentary portion thereof being shown in FIG. 1.

In a preferred embodiment of apparatus 20, FIG. 1, the dancer loading actuator is a pneumatic actuator which has its piston seals removed to reduce friction, and has the controlled air pressure ported to both ends of the actuator cylinder so that the pressure effectively acts on a piston having the area of the cylinder minus the area of the piston rod. That, and the fact that the actuator is pinned with pin 42 to the dancer frame near the proximal end of the dancer frame enables the dancer assembly to respond quickly to changes in web tension so that the nominal tension can be quickly restored, yet the mass of the actuator piston has only nominal effect on the inertia of the dancer due to its short lever arm (the distance between pivot pins 34 and 42). Additionally, the dancer frame and the idler rolls it carries are light weight/low inertia constructions to further enable the dancer assembly to have short response times to upsets: to variations in tension in the web looped through the dancer which cause the dancer to rise (on tension increases) or fall (on tension decreases) until the drive 46 and drive controller 47 respond to reestablish the nominal tension with the dancer disposed at its neutral position.

As shown in FIG. 1, apparatus 20 is forwarding a web 24 under constant tension to equipment not shown which is disposed downstream of apparatus 20; and the roll 23 of web is nearing depletion. Through the joint action of peripheral drive 50 and S-wrap drive 51, the web is unwound by imparting a predetermined fixed-draw in it: i.e., by driving the S-wrap rolls 52 and 53 so that their surface velocities are a predetermined percentage greater than the surface velocity imparted to roll 23 by peripheral drive 50. The drive 46 is slaved to the speed requirement of the downstream equipment (e.g., a converted disposable for manufacturing disposable absorbent products) by the line speed feedback signal 99 into drive controller 47, and the drive 50 is slaved to maintain constant tension in the run of web 24 which is disposed downstream of the S-wrap drive 51 by having the dancer position transducer 36 connected to the drive controller 47 by signal line 100. Alternatively, the line speed feedback signal may be connected to the dancer position transducer so that signal line 100 would carry the speed demand signal with a tension level signal biased thereon. In the event the downstream apparatus is speeded up, the line speed feedback signal 99 increases which is signaled to the drive controller 47, causing the drive 46 to be speeded up. Any disparity between the speed of the drive 46 and that of the downstream equipment is reflected in a change in the tension in the web looped through the dancer assembly 28. The dancer commences to rise with increasing tension or to fall with decreasing tension. This increase or decrease is signaled to the drive controller. The drive controller 47 responds by causing the drive 46 to be speeded up or slowed down sufficiently to stop the rising or falling, respectively, of the dancer, and move it towards the neutral position. This of course manifests restoration of the nominal constant tension in the web being supplied from apparatus 20 to the downstream equipment. Decreases in the speed of the downstream equipment are correspondingly compensated for and so will not be described in greater detail.

Before describing a splicing event, the splicing means 25 will be described.

Splicing means 25, FIG. 1, comprises splicing rolls 81 and 82, optical web-tail detectors 85 and 86, and signal lines 87 and 88. Rolls 81 and 82 preferably have surfaces which provide high coefficients of friction with the webs to be forwarded in order to assure imparting the desired degree of fixed-draw to the webs. In an exemplary embodiment of apparatus 20, rolls 81 and 82 have diameters of about eight cm., and have polyurethane surfaces. As shown in the enlarged scale, perspective view, FIG. 2, splicing rolls 81 and 82 are mounted on shafts 83 and 84, respectively, and indexing means 91 are provided for contrarotating the splicing rolls one-half revolution each upon extension of actuator 108 as will presently be described in greater detail. Additionally, splicing rolls 81 and 82 are oblate inasmuch as they have flattened sides, and diametrically opposed constant diameter face portions; and are sized and disposed to effect web splices upon being contrarotated half revolutions as is further described below.

Figure 2:
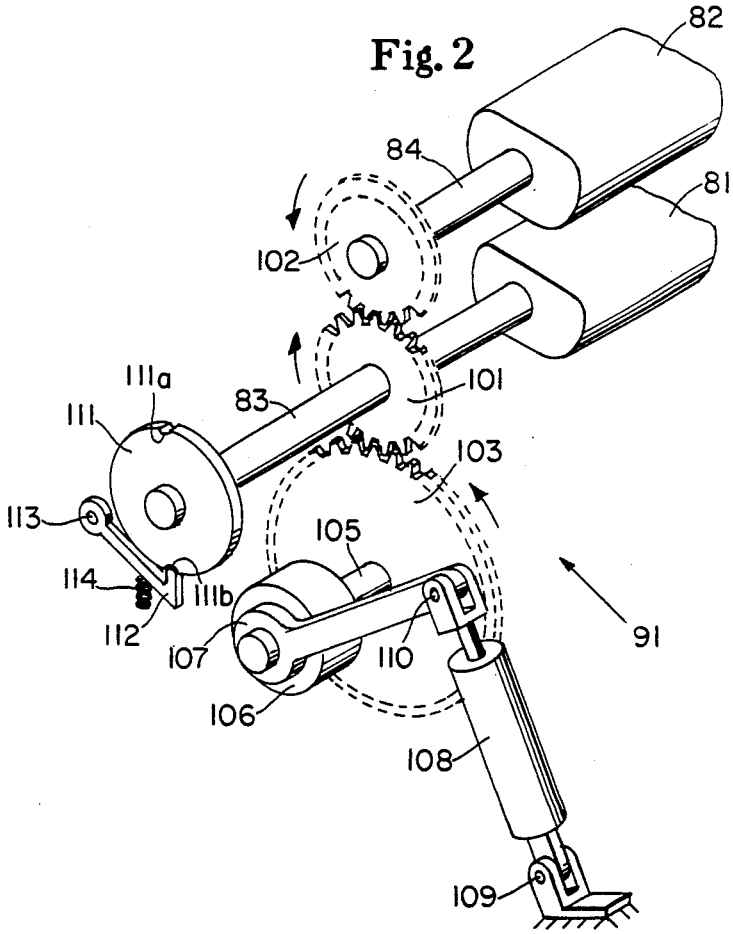
FIG. 2 is a functional pictorial perspective view of the web splicer portion of the apparatus of FIG. 1.

Still referring to FIG. 2, the splicer indexing means 91 is shown to comprise gears 101,102, and 103, which are affixed to shafts 83, 84, and 105, respectively; one-way clutch 106; actuator arm 107; actuator 108 which is pivotally pinned to the frame of the apparatus by pivot pin 109, and pivotally pinned to the distal end of actuator arm 107 by pivot pin 110; and anti-reverse-rotation detent means which comprises an indexing disc 111 having two detents **111*a* and 111*b* disposed at diametrically opposite positions on the perimeter of indexing disc 111, a pawl 112 which has its proximal end pivoted on pin 113 and has its distal end biased against the perimeter of indexing disc 111 by spring 114. The distal end of pawl 112 and the detents 111*a* and 111*b* are complimentarily shaped to enable the pawl to ride up out of the detents when the indexing disc is rotated clockwise as shown in FIG. 2, but to substantially obviate counterclockwise rotation of indexing disc 111**.

Figure 3:
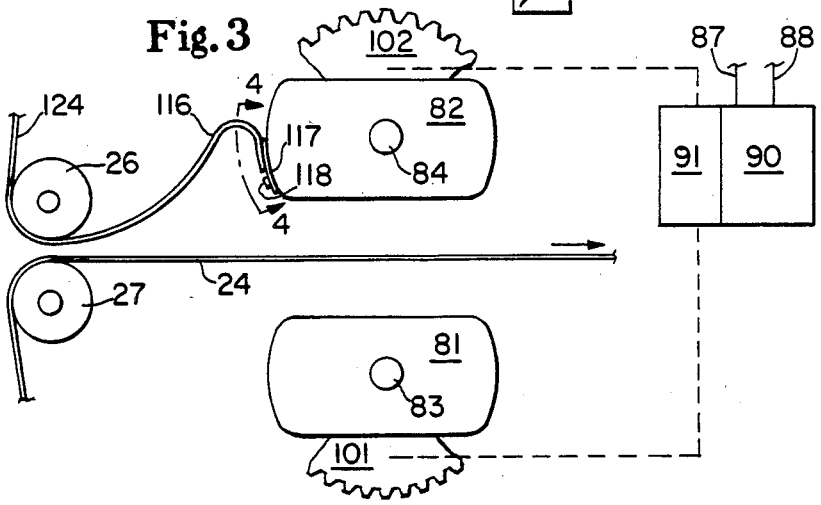
FIG. 3 is an enlarged scale, side elevational view of a fragmentary portion of the web splicer portion of the apparatus of FIG. 1.

Referring now to FIG. 3, the splicing means further comprises a splicing controller 90 which has input signals 87 and 88 connected to it from the web-tail detctors 85 and 86, respectively, and which is connected to indexing means 91. The web indexing means 91 is also shown in FIG. 3 to be mechanically interconnected to gears 101 and 102 as discussed hereinabove with respect to describing FIG. 2. As further indicated in FIG. 3, a leading edge portion 116 of web 124 is looped about idler roll 26 and affixed to a diametral segment of splicing roll 82 through the use of tapes 117 and 118 as is further described below in conjuction with describing FIG. 4. Thus, the leading edge portion 116 of web 124 from roll 123, FIG. 1, is poised in readiness in FIG. 3 to be spliced to the passing web 24 upon initiation of a splicing event. Webs 24 and 124 are identical but have different designators for greater clarity.

Figure 4:
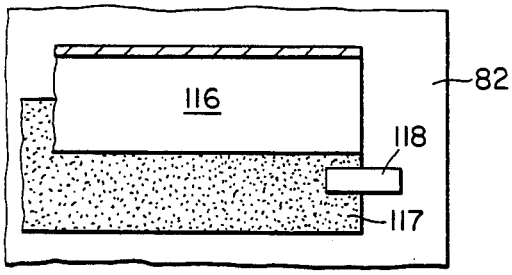
FIG. 4 is a fragmentary view taken along line 4—4 of FIG. 3.

FIG. 4 is a fragmentary view taken along line 4—4 of FIG. 3, and shows a preferred manner in which the leading edge portion 116 of a new roll of web is secured to splicing roll 82. A strip of single-sided adhesive tape 117 is adhered to the leading edge 116 so that the leading edge 116 covers approximately one half the width of tape 117, and so that the adhesive coated side of tape 117 faces away from splicing roll 82. Then, small pieces of rigging tape 118 are applied to lightly secure the ends of tape 117 to the surface of splicing roll 82. In the same manner, the leading edge portions of new rolls of web which are placed in the lower unwind stand 21, FIG. 1, are affixed to splicing roll 81, so will not be described in greater detail.

Referring back to FIG. 1, a splicing event is initiated by the detection of a passing web tail by either of the web tail detectors 85 and 86: detector 85 when a roll of web disposed in the lower unwind stand 21 becomes depleted; and by detector 86 when a roll of web disposed in the upper unwind stand 22 becomes depleted. As is shown in FIG. 1, the detectors 85 and 86 detect the web tails before they pass the S-wrap drives 51 and 151, respectively. This placement is preferred so that the splices can be effected while the web tails are still under the guidance and control of the fixed-draw portion of apparatus 20. By effecting the splices before the web tails enter the constant tension run of the apparatus, splicing transients in the web tension are small.

Upon sensing a passing web tail, detector 85 or 86 signals the splicing controller 90. Controller 90, FIG. 3, causes actuator 108, FIG. 2, to be extended sufficiently to rotate gear 103 a quarter revolution through one-way clutch 106. This causes gears 101 and 102 to be contrarotated through half revolutions: gear 101 being rotated clockwise and gear 102 being rotated counterclockwise. This effects a splice by contrarotating splicing rolls 81 and 82, FIG. 3, so that the exposed adhesive face of tape 117 becomes adhered to the passing portion of web 24. The adhesion of tape 117 to web 24 is sufficient to disengage tapes 118, FIG. 4, from the splicing roll and the splice is complete. Indexing disc 111, FIG. 2, has also been rotated one-half revolution so that the distal end of pawl 112 is now disposed in detent 111a. The splicing controller then causes the actuator 108 to be retracted. Due to the one-way clutch 106, and the anti-rotational function of the pawl 112 with indexing disc 111, retraction of actuator 108 causes no rotation of gears 101, 102 or 103, or of splicing rolls 85 or 86.

Simultaneously with initiating a splicing event, the drive 46, FIG. 1, is declutched from driving the lower unwind stand 21, and clutched by the dual clutch assembly 48 to drive the upper unwind stand 22. Preferably this is accomplished while maintaining the drive 46 at full demand speed; and preferably the dual clutch assembly comprises two air clutches for this purpose. Thus, inasmuch as the drive is kept at demand speed, the new roll can be quickly accelerated by its drive rather than being pulled up to speed by tension in the web. Not having to accelerate the drive to accelerate the new roll of web further contributes to assuring low amplitude and short duration tension disruptions during splicing events: i.e., the inertia of the drive 46 does not have to be overcome during a changeover.

As described above, apparatus 20 comprises exemplary means for unwinding, for example, net-like thermoplastic webs of the type disclosed in the hereinbefore referenced Radel/Thompson patent. For example, apparatus 20 has been used to unwind and forward such a net-like web of polyethylene having a width of about five-and-one-half inches (about 14 cm.) and a basis weight of about twenty-four (24) grams per square meter; and to do such forwarding at up to about one-hundred-seventy-five meters per minute while maintaining as little as about one-third pound (about 150 grams) of total tension in the web in the constant tension run thereof. Concomitantly, a fixed-draw of from about one to about four percent was imparted to the web in the fixed draw portions of apparatus 20. It is, however, not intended to limit the present invention to unwnding only such net-like web, or to this range of draw. For example, for some webs which have been wound under high tension, the draw may indeed have to be negative to relieve some of the wound-in tension so that the web can then be forwarded under a lower level of constant tension; and, for webs which manifest greater blocking, higher draws may be required to assure overcoming the blocking.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus for unwinding a succession of rolls of web material having a tension dependent elongation property, and continuously supplying on demand a running ribbon of said web material to downstream equipment, said apparatus comprising:

a. first and second means for rotatably mounting two rolls of said web material;

b. fixed-draw unwind means for alternately unwinding rolls of web which are rotatably mounted in said first and second means, respectively, by subjecting said web to a predetermined constant draw regardless of tension elongation dependence of said web, said fixed-draw unwind means comprising peripheral roll drive means disposed in peripheral contacting relation with an unwinding roll to effect rotating said unwinding roll at a controlled peripheral velocity, and web draw means disposed adjacent said unwinding roll to effect drawing web from said unwinding roll so that a running length of web which extends intermediate said peripheral roll drive means and said web draw means is traversing a free span therebetween, and is subjected to a constant percentage elongation during said traversing;

c. drive and control means for controlling said fixed-draw unwind means so that it is responsive to a line speed demand from said downstream equipment and so that a predetermined, substantially constant level of tension is maintained in the running ribbon of web downstream from said fixed-draw unwind means; and d. splicing means disposed downstream from said fixed-draw unwind means for splicing the leading edge of each new roll of said web to the tail end of a just-depleted roll of said web, said splicing means being disposed in the constant-controlled-tension run of said web.

2. The apparatus of claim 1 wherein said peripheral drive means comprises a driven belt, and means for biasing a span of said driven belt against the periphery of said roll of web; said web draw means comprises a pair of S-wrap rolls; and said fixed draw unwind means comprises means for powering said S-wrap rolls and said peripheral drive means at a constant velocity ratio with the surface velocities of said S-wrap rolls being in the range of from about one to about four percent faster than the surface velocity of said driven belt.

3. The apparatus of claim 1 further comprising a web-tension-responsive dancer assembly through which the constant tension run of said web is looped, adjustable dancer loading means, and dancer position feedback means to said drive and control means, said drive and control means being responsive to the positional changes of said dancer that increases or decreases in tension will precipitate concomitant increases or decreases, respectively, in the speed of said fixed-draw unwind means to restore the tension to its predetermined nominal constant value.

4. The apparatus of claim 3 wherein said adjustable dancer loading means comprises a differential-area pneumatic cylinder, and means for controlling the pneumatic pressure applied to said actuator.

* * * * *